US008013292B2

(12) United States Patent
Nishiguchi

(10) Patent No.: US 8,013,292 B2
(45) Date of Patent: Sep. 6, 2011

(54) MASS SPECTROMETER

(75) Inventor: Masaru Nishiguchi, Kyoto (JP)

(73) Assignee: Shimadzu Corporation, Tokyo (JP)

( * ) Notice: Subject to any disclaimer, the term of this patent is extended or adjusted under 35 U.S.C. 154(b) by 93 days.

(21) Appl. No.: 12/599,074

(22) PCT Filed: May 9, 2007

(86) PCT No.: PCT/JP2007/000493

§ 371 (c)(1),
(2), (4) Date: Nov. 6, 2009

(87) PCT Pub. No.: WO2008/139507

PCT Pub. Date: Nov. 20, 2008

(65) Prior Publication Data

US 2010/0140469 A1 Jun. 10, 2010

(51) Int. Cl.
*H01J 49/40* (2006.01)
*H01J 49/06* (2006.01)

(52) U.S. Cl. ..... 250/287; 250/281; 250/294; 250/296; 250/396 R; 250/397

(58) Field of Classification Search ..... 250/287, 250/281, 294, 296, 396 R, 396 ML, 397
See application file for complete search history.

(56) References Cited

U.S. PATENT DOCUMENTS

| | | | | |
|---|---|---|---|---|
| 7,355,168 | B2 * | 4/2008 | Yamaguchi | 250/282 |
| 7,361,889 | B2 * | 4/2008 | Yamaguchi | 250/287 |
| 7,763,847 | B2 * | 7/2010 | Nishiguchi et al. | 250/287 |
| 2010/0148061 | A1 * | 6/2010 | Yamaguchi et al. | 250/287 |

FOREIGN PATENT DOCUMENTS

| | | | |
|---|---|---|---|
| JP | 11-195398 | A | 7/1999 |

(Continued)

OTHER PUBLICATIONS

Michisato Toyoda, et al., "Multi-turn time-of-flight mass spectrometers with electrostatic sectors", Journal of Mass Spectrometry, 2003, pp. 1125-1142, vol. 38.

(Continued)

*Primary Examiner* — Nikita Wells
(74) *Attorney, Agent, or Firm* — Sughrue Mion, PLLC

(57) ABSTRACT

One cycle of loop orbit is formed by two identical time-focusing unit structures (T1 and T2). Each of the time-focusing unit structures (T1 and T2) has a time-focusing point (P1) at the injection side and a time-focusing point (P2) at the ejection side. Each of them also has an injection-side free flight space (11) with a length of L1 and an ejection-side free flight space (12) with a length of L1, respectively anterior and posterior to a basic ion optical element (10) for causing ions to fly along a substantially arc-shaped orbit. Another basic ion optical element (30) having the same configuration as that of the basic ion optical element (10) is inserted to the injection-side free flight space (11) so that the distance between the ejection end of the basic ion optical element (30) and the injection end of the basic ion optical element (10) is L1'. The length L0 of the free flight space for injecting ions to the basic ion optical element (30) is set to be the value obtained by L0=2(L1+L2)−(L1'+L2). Accordingly, ions that depart from the starting point (Ps) are time-focused when they arrive at the time-focusing point (P2).

8 Claims, 5 Drawing Sheets

FOREIGN PATENT DOCUMENTS

JP 2006-228435 A 8/2006

OTHER PUBLICATIONS

S. Uchida, et al., "Development of a portable Multi-Turn Time-of-Flight Mass Spectrometer MULTUM S", The 53rd Annual Conference on Mass Spectrometry, 1P-P1-28, 2005, pp. 100-101.

Morio Ishihara, et al., "Perfect space and time focusing ion optics for multiturn time of flight mass spectrometers", International Journal of Mass Spectrometry, 2000, pp. 179-189, vol. 197.

Japanese Office Action dated Mar. 22, 2011, for corresponding Japanese Patent Application No. JP 2009-513853.

* cited by examiner

MASS SPECTROMETER

TECHNICAL FIELD

The present invention pertains to a mass spectrometer including a multi-turn ion optical system in which ions are made to fly repeatedly along a closed loop orbit.

BACKGROUND ART

In a time-of-flight mass spectrometer (TOF-MS), the mass of an ion is generally calculated from the time of flight which is obtained by measuring a period of time required for the ion to fly at a fixed distance, on the basis of the fact that an ion accelerated by a fixed energy has a flight speed corresponding to the mass of the ion. Accordingly, elongating the flight distance is particularly effective to enhance the mass resolution. However, elongation of a flight distance on a straight line requires unavoidable enlargement of the device, which is not practical, so that a mass spectrometer called a multi-turn time-of-flight mass spectrometer has been developed in order to elongate a flight distance.

A multi-turn ion optical system for making ions turn in such a multi-turn time-of-flight mass spectrometer generally has a closed orbit and a unit structure having a time-focusing property (refer to Non-Patent Document 1, for example). To "time-focus" in the present invention means that the time of flight of the ions is not dependent on an initial position, initial angle, and initial energy of the beam of the ions in a first-order approximation. As a component of the multi-turn ion optical system, a sector-formed electric field which has a simple configuration and good versatility is often used. In a multi-turn time-of-flight mass spectrometer as described in Patent Document 1 for example, the flight distance is effectively elongated and the mass resolution of ions is enhanced by forming an approximately figure-eight "8" shaped loop orbit using a plurality of sector-formed electric fields and causing ions to fly along this loop orbit repeatedly multiple times.

In such a mass spectrometer, an ion source for generating ions and an ion detector for detecting ions may be placed on the loop orbit in some cases. However, in many cases, ions generated outside the loop orbit are injected to the loop orbit to fly for a predetermined number of turns, and the ions are deviated from the loop orbit to be introduced to an ion detector provided outside of the loop orbit to be detected. In the apparatus described in Patent Document 1, in order to inject ions to and eject ions from the loop orbit, an opening through which ions can pass is bored in a sector-formed electrode, and the sector-formed electrode is driven in a pulsed manner to inject ions linearly to the loop orbit. In the same manner, ions are ejected from the loop orbit.

In such a manner of injecting and ejecting ions, the variation of the energy of ions is not time-focused in a linear free flight space for injection and ejection, and therefore, when looking at the entire path that ions pass from the starting point of the ions (usually an ion source) to the detection point of the ions (usually an ion detector), the time-focusibility that a multi-turn ion optical system originally has is not assured. This contributes to a decrease in the accuracy of analysis.

This manner requires the connection of a power supply which can supply pulses to the sector-formed electrodes composing a multi-turn ion optical system which can be statically driven (i.e. a direct-current (DC) voltage is applied) in order to cause ions to fly along the loop orbit. This makes it difficult to ensure the stability of the DC voltage applied to the sector-formed electrodes from the power supply, which might exert a negative effect on the accuracy of analysis. In addition, the necessity of preparing such a power supply for supplying pulses and a stable DC voltage increases the cost.

Another method for injecting ions to and ejecting them from a multi-turn ion optical system is to add a sector-formed electric field for the ion injection and for the ion ejection respectively, as described in Non-Patent Document 2. However, in an injection/ejection ion optical system including the added sector-formed electric fields, the time focus at the original time-focusing point of the multi-turn ion optical system is not considered; only the time focus when ions pass each of the injection ion optical system and the ejection ion optical system is insufficiently achieved. Therefore, in order to ensure the time-focusibility at any number of turns, theoretically speaking, the multi-turn ion optical system is required to satisfy a very strict condition which is called the "perfect focusing condition" under which not only ions are temporally focused at the focusing point but the deviation and angle of the orbit of the ions are the same before and after the flight along the loop orbit. Designing an ion optical system that satisfies this condition is very difficult, and even if it can be designed, it will be awkward with little flexibility in the arrangement and size of the optical elements.

[Patent Document 1] Japanese Unexamined Patent Application Publication No. H11-195398

[Non-Patent Document 1] M. Toyoda and three other authors, "Multi-turn time-of-flight mass spectrometers with electrostatic sectors," Journal of Mass Spectrometry, 2003, 38, pp. 1125-1142

[Non-Patent Document 2] S. Uchida and five other presenters, "Development of a portable Multi-Turn Time-of-Flight Mass Spectrometer MULTUM S," Abstract of The 53rd Annual Conference On Mass Spectrometry, 1P-P1-28, 2005, pp. 100-101

[Non-Patent Document 3] M. Ishihara and two other authors, "Perfect space and time focusing ion optics for multiturn time of flight mass spectrometers," International Journal of Mass Spectrometry, 2000, 197, pp. 179-189

DISCLOSURE OF THE INVENTION

Problem to be Solved by the Invention

The present invention is accomplished to solve the aforementioned problem, and the main objective thereof is to provide a mass spectrometer including an ion injection optical system and/or an ion ejection optical system capable of injecting and/or ejecting ions to the loop orbit while statically maintaining the sector-formed electric fields which compose a multi-turn ion optical system, and capable of achieving a time focus with regard to an original time-focusing point of a multi-turn ion optical system.

Means for Solving the Problem

To solve the previously described problem, the first aspect of the present invention provides a mass spectrometer having a multi-turn optical system for forming a closed loop orbit in which a plurality of sector-formed electric field and free flight spaces free from an electric field are combined, and the mass spectrometer in which ions are made to fly along the loop orbit repeatedly so as to separate the ions in accordance with their mass-to-charge ratio, wherein:

the multi-turn ion optical system is composed of a plurality of connected time-focusing unit structures, and each of the time-focusing unit structures includes:

a basic ion optical element including at least one sector-formed electric field, having a time-focusing property with respect to the variation of the initial position and the initial angle of the ions, and satisfying a condition that a temporal aberration coefficient dependent on an energy of an ion is positive;

an injection-side free flight space for guiding an ion so as to inject the ion to the basic ion optical element; and an ejection-side free flight space for guiding an ion that has exited from the basic ion optical element, a basic ion optical element for injection ion optical system is inserted in an injection-side free flight space in one of the plurality of time-focusing unit structures in such a manner that the ejection axis of the basic ion optical element for injection ion optical system coincides with the injection axis of the injection-side free flight space; and an injection-side free flight space is placed between the injection end of the basic ion optical element for injection ion optical system and an ion starting point, where the injection-side free flight space has a length uniquely determined by: the distance from the ejection end of the basic ion optical element for injection ion optical system to the injection end of a basic ion optical element in the time-focusing unit structure in which the basic ion optical element for injection ion optical system is inserted; the length of an injection-side free flight space in the time-focusing unit structure; and the length of an ejection-side free flight space in the time-focusing unit structure.

The second aspect of the present invention achieved to solve the previously described problem provides a mass spectrometer having a multi-turn optical system for forming a closed loop orbit in which a plurality of sector-formed electric field and free flight spaces free from an electric field are combined, and the mass spectrometer in which ions are made to fly along the loop orbit repeatedly so as to separate the ions in accordance with their mass-to-charge ratio, wherein:

the multi-turn ion optical system is composed of a plurality of connected time-focusing unit structures, and each of the time-focusing unit structures includes:

a basic ion optical element including at least one sector-formed electric field, having a time-focusing property with respect to a variation of the initial position and the initial angle of the ions, and satisfying a condition that a temporal aberration coefficient dependent on an energy of an ion is positive;

an injection-side free flight space for guiding an ion so as to inject the ion to the basic ion optical element; and an ejection-side free flight space for guiding an ion that has exited from the basic ion optical element, a basic ion optical element for ejection ion optical system is inserted in an ejection-side free flight space in one of the plurality of time-focusing unit structures in such a manner that the injection axis of the basic ion optical element for ejection ion optical system coincides with the ejection axis of the ejection-side free flight space; and an ejection-side free flight space is placed between an ejection end of the basic ion optical element for ejection ion optical system and an ion detection point, where the ejection-side free flight space has a length uniquely determined by: the distance from the injection end of the basic ion optical element for ejection ion optical system to the ejection end of a basic ion optical element in the time-focusing unit structure in which the basic ion optical element for ejection ion optical system is inserted; the length of an injection-side free flight space in the time-focusing unit structure; and the length of an ejection-side free flight space in the time-focusing unit structure.

In the mass spectrometer according to the first and second aspects of the present invention, the sector-formed electric field may be formed by, for example, a sector-formed electrode composed of a pair of an outer electrode and an inner electrode. The basic ion optical element which composes the time-focusing unit structure and included in the injection ion optical system or the ejection ion optical system can be composed of at least one sector-formed electric field. Generally, a basic ion optical element composed of a plurality of sector-formed electric fields and free flight spaces between the adjacent sector-shaped electric fields has a larger flexibility in the arrangement and size. The ion starting point is generally the position where an ion source for generating ions is placed. Since the ion starting point can be anywhere in so far as it is the point where ions start to fly, it may be the position where an ion trap for temporarily storing ions and ejecting them at a predetermined timing or other unit is placed. The ion detection point is generally the position where an ion detector for detecting ions is placed. Since the basic ion optical element of the injection ion optical system and that of the ejection ion optical system are placed on the loop orbit, in the case where the sector-formed electrode and the loop orbit intersect, an appropriate opening through which ions flying along the loop orbit can pass may be provided in the sector-formed electrode.

Effects of the Invention

In the mass spectrometer according to the first and second aspects of the present invention, the sector-formed electric fields included in the multi-turn ion optical system can only be a static electric field. In order to introduce ions to the loop orbit through the injection ion optical system or in order to eject ions from the loop orbit through the ejection optical system, a predetermined voltage may be applied to the sector-formed electrode included in the basic ion optical element of the injection ion optical system or that of the ejection ion optical system to form a sector-formed electric field. While ions fly and turn along the loop orbit, a voltage is not applied to the sector-formed electrode included in the basic ion optical element of the injection ion optical system or that of the ejection ion optical system in order to eliminate the effect of the sector-formed electric field by this electrode. Therefore, in the mass spectrometer according to the first and second aspects of the present invention, only a power supply capable of applying a DC voltage is required to be connected to the sector-formed electrodes included in the multi-turn ion optical system, which can ensure the stability of the electric potential in the sector-formed electric fields while ions fly and turn repeatedly, and suppress the deviation of the flight orbit of ions. This increases the accuracy of the mass analysis, and this effect is significant particularly in the case where the number of turns is set to be large to elongate the flight distance.

In the mass spectrometer according to the first aspect of the present invention, the length of the injection-side free flight space between the injection end of the basic ion optical element for injection ion optical system and the ion starting point is adjusted to cancel the sum of the temporal aberration coefficients which depend on the energies generated in the basic ion optical element for injection ion optical system and in the time-focusing unit structure of the multi-turn ion optical system.

To perform such an adjustment, in particular, the length L0 of the injection-side free flight space between the injection end of the basic ion optical element for injection ion optical system and the ion starting point may be determined by the following equation:

$$L0=2(L1+L2)-(L1'+L2)$$

where L1' is the distance from the ejection end of the basic ion optical element for injection ion optical system to the injection end of the basic ion optical element in the time-focusing unit structure in which the basic ion optical element for injection ion optical system is inserted, L1 is the length of the injection-side free flight space in the time-focusing unit structure, and L2 is the length of the ejection-side free flight space in the time-focusing unit structure.

Likewise, in the mass spectrometer according to the first aspect of the present invention, the length of the ejection-side free flight space between the ejection end of the basic ion optical element for ejection ion optical system and the ion detection point is adjusted to cancel the sum of the temporal aberration coefficients which depend on the energies generated in the basic ion optical element for ejection ion optical system and in the time-focusing unit structure of the multi-turn ion optical system.

To perform such an adjustment, in particular, the length L0 of the ejection-side free flight space between the ejection end of the basic ion optical element for ejection ion optical system and the ion detection point may be determined by the following equation:

$$L0=2(L1+L2)-(L1'+L2)$$

where L1' is the distance from the injection end of the basic ion optical element for ejection ion optical system to the ejection end of the basic ion optical element in the time-focusing unit structure in which the basic ion optical element for ejection ion optical system is inserted, L1 is the length of the injection-side free flight space in the time-focusing unit structure, and L2 is the length of the ejection-side free flight space in the time-focusing unit structure.

The end point of the ejection-side free flight space of the time-focusing unit structure in which the basic ion optical element for injection ion optical system is inserted and the starting point of the injection-side free flight space of the time-focusing unit structure in which the basic ion optical element for ejection ion optical system is inserted are both a time-focusing point at which the same time of flight of ions of the same mass is obtained even if they have a variety of energies. Hence, determining the length of the injection-side free flight space between the injection end of the basic ion optical element for injection ion optical system and the ion starting point so as to satisfy the aforementioned condition corresponds to determining the position of the ion starting point with which a time focus is achieved with respect to the time-focusing point in the multi-turn ion optical system. Likewise, determining the length of the ejection-side free flight space between the ejection end of the basic ion optical element for ejection ion optical system and the ion detection point so as to satisfy the aforementioned condition corresponds to determining the position of the ion detection point with which a time focus is achieved with respect to the time-focusing point in the multi-turn ion optical system.

Therefore, ions departed from the ion starting point pass through the injection ion optical system to be placed into the loop orbit by the multi-turn ion optical system. When they reach the end point of the ejection-side free flight space of the time-focusing unit structure in which the basic ion optical element for injection ion optical system is inserted, they are time-focused once, and they are ensured to be time-focused regardless of the number of turns and other conditions thereafter. When ions turning along the loop orbit leave the loop orbit through the ejection ion optical system, the ions are also ensured to be time-focused at the moment they reach the ion detection point. Hence, even in the case where ions of the same mass have a variety of energies, these ions have approximately the same time of flight, achieving a high mass resolution and mass accuracy. Since the insertion position of the basic ion optical element for injection ion optical system and the basic ion optical element for ejection ion optical system is flexible, their position can be appropriately determined in such a manner as to minimize the size of the apparatus, for example.

The basic ion optical element for injection ion optical system or the basic ion optical element for ejection ion optical system can be any as long as it includes at least one sector-formed electric field, has a time-focusing property with respect to the variation of the initial position and the initial angle of ions, and satisfies a condition that the temporal aberration coefficient dependent on the energy of ions is positive. However, the basic ion optical element for injection ion optical system or the basic ion optical element for ejection ion optical system may have the same configuration as the configuration of the basic ion optical element of the time-focusing unit structure which composes the multi-turn ion optical system. This uniforms the kind of sector-formed electrodes to be prepared, which is advantageous in reducing the cost of the apparatus.

EXPLANATION OF NUMERALS

T1, T2, T3, T4 . . . Time-Focusing Unit Structure
P1, P2, P3, P4 . . . Time-Focusing Point
Pd . . . Ion Detection Point
Ps . . . Ion Starting Point
10, 30 . . . Basic Ion Optical Element
11, 31 . . . Injection-Side Free Flight Space
12 . . . Ejection-Side Free Flight Space

40, 41, 46, 50, 51, 55, 56, 60, 61, 70, 71, 75, 76 . . . Sector-Formed Electric Field
43, 48, 53, 57, 63, 68, 73, 77 . . . Free Flight Space
42, 47, 52, 62, 67, 72 . . . Injection-Side Free Flight Space
44, 49, 58, 64, 69, 78 . . . Ejection-Side Free Flight Space

BEST MODES FOR CARRYING OUT THE INVENTION

Figure 9:
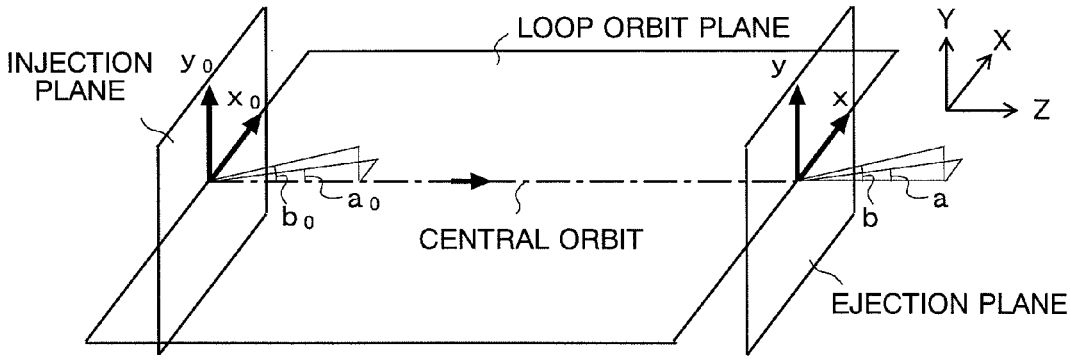
FIG. 9 is a reference diagram for explaining a method to express the orbit of ions.

Explained first is a method to express an ion orbit which will be used in the following explanation with reference to FIG. 9. Now, suppose that ions are injected from the injection plane on the left in the figure, pass through a predetermined ion optical axis including sector-formed electric fields and other components, and then are ejected from the ejection plane on the right in the figure. The central orbit of ions is drawn by a straight line in FIG. 9 for convenience of explanation. The traveling direction of this ion is Z direction. An ion having a specific energy and a specific mass-to-charge ratio will follow the central orbit; this ion is defined as a reference ion. If an ion departing from the injection plane initially has deviations from the reference ion in terms of position, angle (or flight direction), and kinetic energy, that ion will have deviations to the central orbit when it arrives at the ejection plane. Such deviations can be expressed by first-order approximation equations as follows according to a known theory of ion optical systems:

$$x=(x|x)x_0+(x|a)a_0+(x|d)d \tag{1}$$

$$a=(a|x)x_0+(a|a)a_0+(a|d)d \tag{2}$$

$$y=(y|y)y_0+(y|b)b_0 \tag{3}$$

$$b=(b|y)y_0+(b|b)b_0 \tag{4}$$

$$l=(l|x)x_0+(l|a)a_0+(l|d)d \tag{5}$$

Here, $x_0$ and $a_0$ are, respectively, an amount of deviation of a position in a direction orthogonal to the central orbit (or X direction in FIG. 9) and that of an angle (or flight direction) to the central orbit within the loop orbit plane at the injection plane. The parameters $y_0$ and $b_0$ are, respectively, an amount of deviation of a position in a direction orthogonal to the central orbit and that of an angle to the central orbit within a plane perpendicular to the loop orbit plane at the injection plane. The parameters x and a are, respectively, an amount of deviation of a position in a direction orthogonal to the central orbit (or X direction in FIG. 9) and that of an angle to the central orbit within the loop orbit plane at the ejection plane. The parameters y and b are, respectively, an amount of deviation of a position in a direction orthogonal to the central orbit (or Y direction in FIG. 9) and that of an angle to the central orbit within a plane perpendicular to the loop orbit plane at the ejection plane. The parameter d is an amount of deviation of energy at the injection plane. The parameter l expresses an amount of deviation (i.e. advance and delay) in the flight distance of a predetermined ion from the reference ion in a direction parallel to the central orbit, and corresponds to a deviation in the time of flight from the reference ion. Moreover, (x|x), . . . , and (l|d) are called a first-order aberration coefficient, and are constants of the ion optical system, each determined by the elements indicated in the parentheses "( )". The first-order aberration coefficients appearing in the equations (1) through (4) are spatial aberration coefficients that affect the spatial orbit stability, and the first-order aberration coefficients appearing in the equation (5) are temporal aberration coefficients that affect the time-focusing property.

It is known that a space-focusing condition with respect to the first-order temporal aberration coefficients (l|x), (l|a), and (l|d) is generally given by the following equation:

$$(l|x)=(l|a)=(l|d)=0 \tag{6}$$

In the case where ions sequentially pass through a plurality of ion optical elements (which are normally electrodes that form electric fields), each aberration coefficient after passing through the nth ion optical element is computed as follows according to a theory of ion optical systems:

$$(x|x)_n=(x|x)(x|x)_{n-1}+(x|a)(a|x)_{n-1} \tag{7}$$

$$(a|a)_n=(a|x)(x|a)_{n-1}+(a|a)(a|a)_{n-1} \tag{8}$$

$$(l|x)_n=(l|x)(x|x)_{n-1}+(l|a)(a|x)_{n-1}+(l|x)_{n-1} \tag{9}$$

$$(l|a)_n=(l|x)(x|a)_{n-1}+(l|a)(a|a)_{n-1}+(l|a)_{n-1} \tag{10}$$

$$(l|d)_n=(l|x)(x|d)_{n-1}+(l|a)(a|d)_{n-1}+(l|d)_{n-1}+(l|d) \tag{11}$$

In the above equations (7) through (11), the aberration coefficients with a subscript (e.g. "n−1") express aberration coefficients after ions have sequentially passed through ion optical elements, the number of which is indicated by the index of the subscript. The aberration coefficients without an index represent the aberration coefficient of the nth ion optical element alone. Although the explanation made thus far is only for X direction, the same explanation is made for Y direction.

Figure 1:
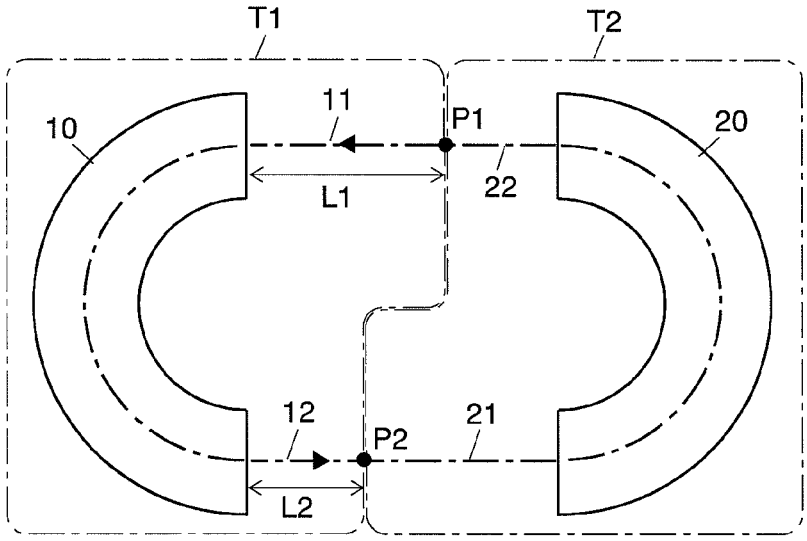
FIG. 1 is a schematic configuration diagram illustrating an example of a multi-turn ion optical system.

Next, the time-focusing unit structure which composes a multi-turn ion optical system will be described. On the injection side and on the ejection side of an ion optical system are ensured a free flight space without an ion optical element, i.e. free from an electric field nor magnetic field. FIG. 1 is a schematic diagram illustrating an example of a multi-turn ion optical system. In this example, one cycle of loop orbit is formed by two time-focusing unit structures T1 and T2. The time-focusing unit structure T1 (and T2) has a time-focusing point P1 at its injection side and a time-focusing point P2 at its ejection side. A free flight space 11 having a length of L1 and a free flight space 12 having a length of L2 are respectively placed anterior and posterior to a basic ion optical element 10 for causing ions to fly along an approximately arc-shaped orbit. That is, in this example, ions pass a time-focusing point at every half turn of the loop orbit.

The equations (7) through (11) in the matrix form are called a transfer matrix, and the transfer matrix of a free flight space having a length of L is expressed as follows:

$$\begin{pmatrix} x \\ a \\ d \\ l \end{pmatrix} = \begin{pmatrix} 1 & L & 0 & 0 \\ 0 & 1 & 0 & 0 \\ 0 & 0 & 1 & 0 \\ 0 & 0 & -L/2 & 1 \end{pmatrix} \begin{pmatrix} x_0 \\ a_0 \\ d \\ l_0 \end{pmatrix} \tag{12}$$

Hereinafter, it is assumed that a transfer matrix has the same structure as the equation (12) with respect to X direction. A transfer matrix of a time-focusing unit structure excluding an injection free flight space and an ejection free flight space, i.e. a basic ion optical element, is expressed as follows:

$$\begin{pmatrix} (x|x) & (x|a) & (x|d) & 0 \\ (a|x) & (a|a) & (a|d) & 0 \\ 0 & 0 & 1 & 0 \\ (l|x) & (l|a) & (l|d) & 1 \end{pmatrix} \tag{13}$$

A transfer matrix for the entire time-focusing unit structure is computed by $$\begin{pmatrix} 1 & L2 & 0 & 0 \\ 0 & 1 & 0 & 0 \\ 0 & 0 & 1 & 0 \\ 0 & 0 & -L2/2 & 1 \end{pmatrix} \tag{14}$$

$$\begin{pmatrix} (x|x) & (x|a) & (x|d) & 0 \\ (a|x) & (a|a) & (a|d) & 0 \\ 0 & 0 & 1 & 0 \\ (l|x) & (l|a) & (l|d) & 1 \end{pmatrix} \begin{pmatrix} 1 & L1 & 0 & 0 \\ 0 & 1 & 0 & 0 \\ 0 & 0 & 1 & 0 \\ 0 & 0 & -L1/2 & 1 \end{pmatrix}$$

where L1 is the length of the injection-side free flight space and L2 is the length of the ejection-side free flight space as illustrated in FIG. 1. In this case, the temporal aberration coefficients are:

$$(l|x)_t=(l|x) \tag{15}$$

$$(l|a)_t=(l|x)L1+(l|a) \tag{16}$$

$$(l|d)_t=(l|d)-(L1+L2)/2 \tag{17}$$

where the subscript t indicates an entire aberration coefficient.

Given that a time focus is achieved, the equation (6) gives:

$$(l|x)_t=(l|a)_t=(l|d)_t=0.$$

Hence, the equations (15) through (17) will be:

$$(l|x)_t=(l|x)=0 \tag{18}$$

$$(l|a)_t=(l|x)L1+(l|a)=(l|a)=0 \tag{19}$$

$$(l|d)_t=(l|d)-(L1+L2)/2=0 \tag{20}.$$

This shows that the flight time focuses regarding (l|x) and (l|a) are achieved only by the basic ion optical element without the injection free flight space and ejection free flight space, and are dependent neither on the length of the injection free flight space nor the ejection free flight space. It is understood that the action of the injection free flight space and ejection free flight space from the standpoint of an ion optical property is only to cancel the temporal aberration coefficient (l|d) by the summation of the length of the injection free flight space and that of the ejection free flight space. The temporal aberration coefficient (l|d) is dependent on the energy generated in the basic ion optical element without the injection free flight space and ejection free flight space. The characteristic of the basic ion optical element is to satisfy the following condition given from the equations (18) and (19):

$$(l|x)=(l|a)=0,\ (l|d)>0 \tag{21}$$

In other words, an ion optical element satisfying the equation (21) and without an injection free flight space nor ejection free flight space is the basic ion optical element.

The aforementioned ion optical knowledge indicates that the basic ion optical element can be a candidate for an ion optical system that can be combined with an already existing time-focusing unit structure as a multi-turn ion optical system with its time-focusing points P (P1 and P2 in FIG. 1) so as to achieve a time focus at the time-focusing points P. As shown by the equations (18) and (19), the basic ion optical element already achieves by itself the time focus with respect to the initial position and initial angle. A time focus with respect to energy can be easily achieved by adjusting the distance of the free flight space.

Figure 2:
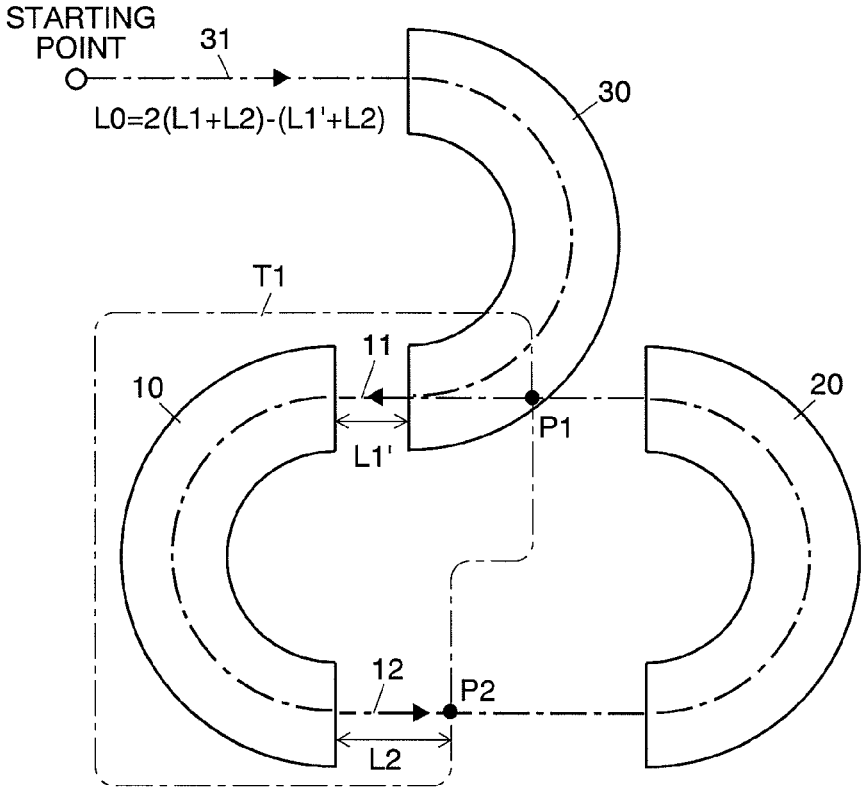
FIG. 2 is a schematic configuration diagram illustrating a state in which an injection ion optical system is included in the multi-turn ion optical system illustrated in FIG. 1.

As an example, an explanation will be made for designing an injection ion optical system in which another basic ion optical element is inserted in the injection-side free flight space of the time-focusing unit structure T1 in FIG. 1 so that a time focus is achieved at the time-focusing point P2. FIG. 2 is a schematic diagram illustrating the state where this injection ion optical system is included.

First, another basic ion optical element 30 is placed in the injection-side free flight space 11 of the time-focusing unit structure T1 with an appropriate distance L1' from the injection end of the basic ion optical element 10. At this point in time, the time focusing with respect to the initial position and initial angle at the time-focusing point P2 in the multi-turn ion optical system is ensured with any distance of the injection-side free flight space 31 with respect to the injected basic ion optical element 30. As for the time focusing with regard to energy, the following consideration can be made: at this point in time, the temporal aberration coefficient with respect to the energy generated by the two basic ion optical elements 30 and 10 existing in the injection optical system is 2(l|d). Therefore, the equation (20) indicates that the time focusing with respect to energy at the time-focusing point P2 is achieved if the total distance of the free flight spaces excluding the two basic ion optical elements 30 and 10 is L1+L2 in the injection ion optical system. Accordingly, it is concluded that the length L0 of the injection-side free flight space 31 with respect to the injected basic ion optical element can be expressed by the following equation:

$$L0=2(L1+L2)-(L1'+L2) \tag{22}.$$

A basic ion optical element which is additionally inserted as in the previously described example is not necessarily to compose a time-focusing unit structure, but can be any so far as it satisfies the condition of the equation (21) which is the property required as a basic ion optical element. For example, in the case where a basic ion optical element in which (l|d)'=(L3+L4)/2 is adopted, the length L0 will be:

$$L0=(L1+L2+L3+L4)-(L1'+L2) \tag{23}.$$

As for the ejection optical system, it can also be designed by the same manner as in the case of the aforementioned injection ion optical system. That is, starting from the time-focusing point of the multi-turn ion optical system, the basic ion optical element is placed in the ejection-side free flight space of the time-focusing unit structure, and the distance of the ejection-side free flight space of the added basic ion optical element is adjusted. In this manner, an ejection ion optical system which achieves the time focusing can be easily designed.

Explained next will be a specific configuration example that the inventor of the present patent application has confirmed that the time focusing is achieved by an orbital computation using a simulation.

First Embodiment

Figure 3:
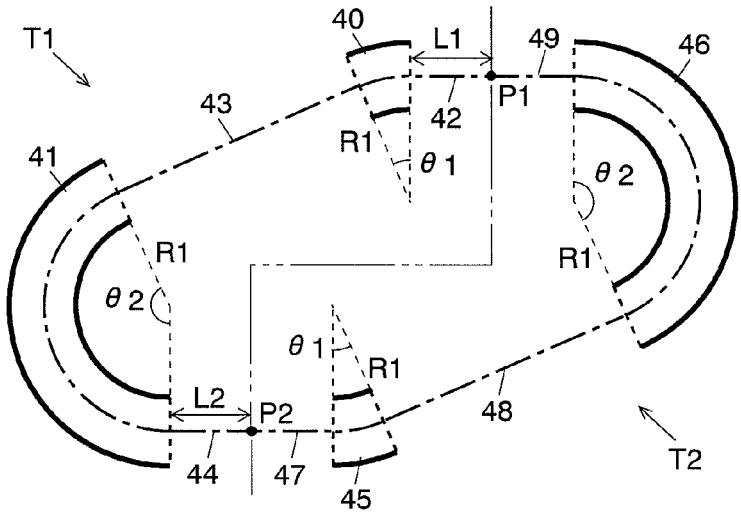
FIG. 3 is a schematic configuration diagram illustrating a state in which an injection optical system and an ejection optical system are not provided yet in the multi-turn ion optical system according to an embodiment (or first embodiment) of the present invention.

FIG. 3 is a schematic diagram illustrating a state in which an injection optical system is not provided yet, i.e. a state where only a loop orbit is achieved, in the multi-turn ion optical system according to an embodiment (the first embodiment) of the present invention. The parameters of each of the elements composing this multi-turn ion optical system are shown in Table 1. The numeral in the parentheses "[ ]" in Table 1 corresponds to the numeral of each element in FIG. 3. This will be the same in other tables below.

Figure 4:
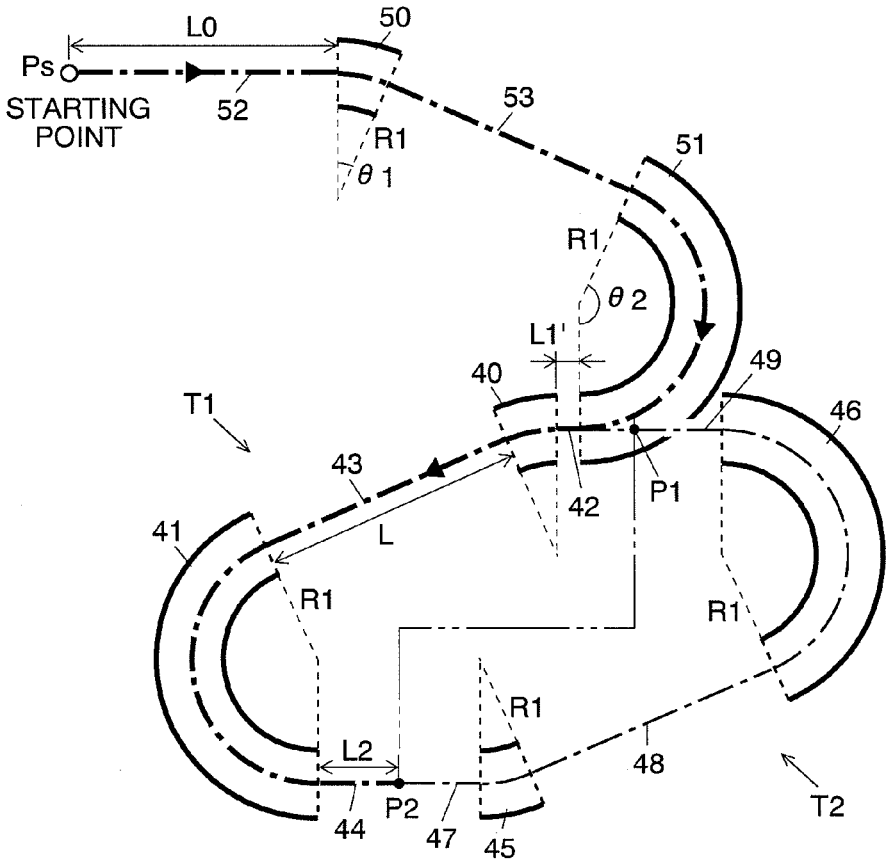
FIG. 4 is a schematic configuration diagram illustrating a state in which an injection ion optical system is included in the multi-turn ion optical system illustrated in FIG. 3.

FIG. 4 is a schematic configuration diagram of an example in the case where the injection ion optical system according to the present invention is provided in the multi-turn ion optical system illustrated in FIG. 3. The parameters of each element in this case are shown in Table 2.

TABLE 1

| | | | |
|---|---|---|---|
| Time-Focusing Unit Structure [T1] | Basic Ion Optical Element 1 | Free Flight Space L1 [42] | 0.6429 |
| | | Sector-Formed Electric Field [40] | Radius R1: 1<br>Deflection Angle θ1: 23.8 deg |
| | | Free Flight Space L [43] | 2.0637 |
| | | Sector-Formed Electric Field [41] | Radius R1: 1<br>Deflection Angle θ2: 156.2 deg |
| | | Free Flight Space L2 [44] | 0.6429 |
| Time-Focusing Unit Structure [T2] | Basic Ion Optical Element 1 | Free Flight Space L1 [47] | 0.6429 |
| | | Sector-Formed Electric Field [45] | Radius R1: 1<br>Deflection Angle θ1: 23.8 deg |
| | | Free Flight Space L [48] | 2.0637 |
| | | Sector-Formed Electric Field [46] | Radius R1: 1<br>Deflection Angle θ2: 156.2 deg |
| | | Free Flight Space L2 [49] | 0.6429 |

(1|x) = 0.000, (1|a) = 0.000, (1|d) = 0.000
L1 + L2 = 1.2858

TABLE 2

| | | |
|---|---|---|
| | Free Flight Space L0 [52] | 1.7288 |
| Basic Ion Optical Element 1 | Sector-Formed Electric Field [50] | Radius R1: 1<br>Deflection Angle θ1: 23.8 deg |
| | Free Flight Space L [53] | 2.0637 |
| | Sector-Formed Electric Field [51] | Radius R1: 1<br>Deflection Angle θ2: 156.2 deg |
| | Free Flight Space L1'<br>Inverted Deflection | 0.2000 |
| Basic Ion Optical Element 1 | Sector-Formed Electric Field [40] | Radius R1: 1<br>Deflection Angle θ1: 23.8 deg |
| | Free Flight Space L [43] | 2.0637 |
| | Sector-Formed Electric Field [41] | Radius R1: 1<br>Deflection Angle θ2: 156.2 deg |
| | Inverted Deflection<br>Free Flight Space L2 [44] | 0.6429 |

(1|x) = 0.000, (1|a) = 0.000, (1|d) = 0.000
L0 = 2(L1 + L2) − (L1' + L2)

I n this multi-turn ion optical system, one cycle of loop orbit is composed of two time-focusing unit structures T1 and T2. In one time-focusing unit structure T1, a basic ion optical element includes two sector-formed electric fields 40 and 41 and a free flight space 43 with a length of L existing between these two sector-formed electric fields 40 and 41. Each of the sector-formed electric fields 40 and 41 is formed by a sector-formed electrode composed of an outer electrode and an inner electrode. The sector-formed electric fields 40 and 41 have a common radius of the central orbit, R1=1. The anteriorly-located sector-formed electric field 40 has a deflection angle of 23.8 [deg], and the posteriorly-located sector-formed electric field 41 has a deflection angle of 156.2 [deg]. With respect to this basic ion optical element, a free flight space 42 with a length of L1 is provided at the injection side, and a free flight space 44 with a length of L2 at the ejection side, guaranteeing that ions departing from the time-focusing point P1 are time-focused at the point P2. The other time-focusing unit structure T2 has exactly the same configuration and parameters as the time-focusing unit structure T1. Regarding this multi-turn ion optical system, a numerical computation has confirmed that (l|x)=(l|a)=(l|d)=0 is satisfied at the time-focusing points P1 and P2 at every half turn of the loop orbit.

In the injection-side free flight space 42 of the time-focusing unit structure T1 is inserted a new ion optical element including sector-formed electric fields 50 and 51, and a free flight space 53. The length L1' of the free flight space between the ejection end section of the sector-formed electric field 51 and the injection end section of the sector-formed electric field 40 of the time-focusing unit structure T1 is set to be 0.2. The parameters of the newly-added basic ion optical element are exactly the same as those of the time-focusing unit structures T1 and T2.

Now, the distance L0 of the injection-side free flight space 52 between the ion starting point Ps and the injection end section was obtained and determined from the equation (22): L0=1.7288. Regarding the injection ion optical system designed in this manner, a numerical computation has confirmed that (l|x)=(l|a)=(l|d)=0 is satisfied at the time-focusing point P2 of the multi-turn ion optical system. That is, ions are time-focused when they reach the time-focusing point P2 after departing from the ion starting point Ps and passing through the central orbit indicated by a bold long dashed short dashed line in FIG. 4. Therefore, after that, the ions flying along the loop orbit formed by the two time-focusing unit structures T1 and T2 are assuredly time-focused also at the time-focusing points P1 and P2. Since the distance L1' can be determined to be any value equal to or less than L1 for the reasons mentioned above, the electrode for forming the sector-formed electric field 51 can be appropriately placed at the position where it does not interfere the electrode for forming the sector-formed electric field 46, or at the position where the size of the entire apparatus is properly decreased.

In order to ensure the loop orbit, an opening for allowing ions to pass though is required to be bored in the electrode (or outer electrode) for forming the sector-formed electric field 51. Since the provision of the opening might disturb the sector-formed electric field 51, in order to alleviate the effect of the turbulence, a metal mesh or wires may be placed or an electrode for correcting the electric field may be provided at the opening.

Figure 5:
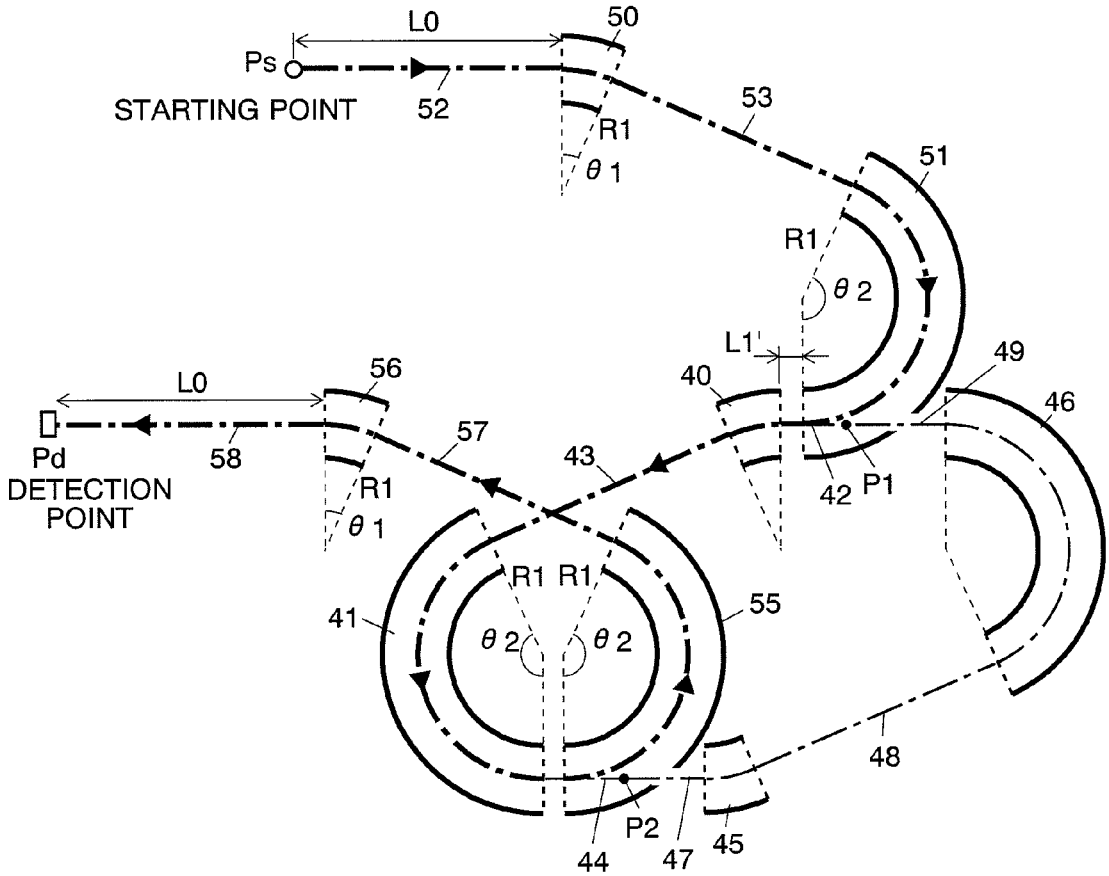
FIG. 5 is a schematic configuration diagram illustrating a state in which an injection ion optical system and an ejection ion optical system are included in the multi-turn ion optical system illustrated in FIG. 3.

Meanwhile, an ejection ion optical system for ejecting outside ions flying along the loop orbit can also be configured as the aforementioned injection ion optical system. FIG. 5 is a schematic configuration diagram of an example in the case where the ejection ion optical system according to the present invention is further provided to the multi-turn ion optical system illustrated in FIG. 4. That is, a new basic ion optical element including the sector-formed electric fields 55 and 56 and the free flight space 57 is inserted in the ejection-side free flight space 44 in the time-focusing unit structure T1. The distance L1' of the free flight space between the injection end section of the sector-formed electric field 55 and the ejection end section of the sector-formed electric field 41 of the time-focusing unit structure T1 is set to be 0.2. The parameters of the newly-added basic ion optical element are also exactly the same as those of the time-focusing unit structures T1 and T2. The distance L0 of the ejection-side free flight space 58 between the ejection end section of the sector-formed electric field 56 and the detection point Pd was obtained and determined to be 1.7288 from the equation (22). Regarding the ejection ion optical system having such a configuration, a numerical computation has confirmed that a time focusing is achieved at the detection point Pd with the starting point of the time-focusing point P1 of the multi-turn ion optical system.

In connecting a basic ion optical element, the direction of deflection can be appropriately adjusted in consideration of the installation area and other factors because the direction of deflection by a sector-formed electric field does not affect temporal aberration coefficients.

Second Embodiment

Figure 6:
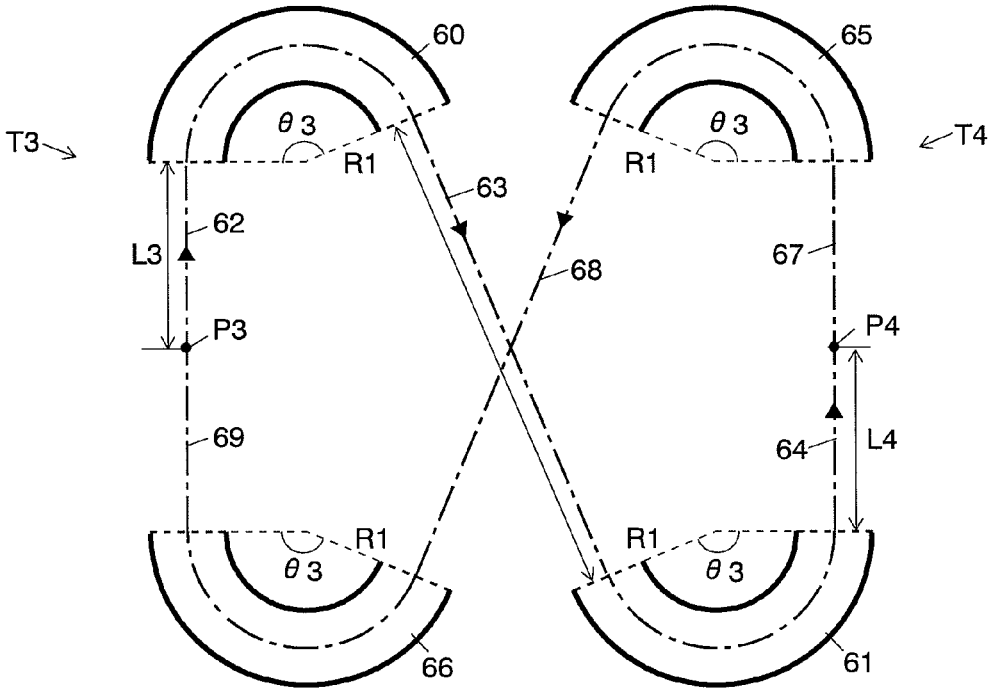
FIG. 6 is a schematic configuration diagram illustrating a state in which an injection optical system and an ejection optical system are not provided yet in the multi-turn ion optical system according to an embodiment (or second embodiment) of the present invention.

FIG. 6 is a schematic diagram illustrating a state in which an injection ion optical system is not provided yet, i.e. a state where only a loop orbit is achieved, in the multi-turn ion optical system according to the second embodiment with a different configuration from that of the aforementioned embodiment. The parameters of each element composing this multi-turn ion optical system are shown in Table 3.

TABLE 3

| | | | |
|---|---|---|---|
| Time-Focusing Unit Structure [T3] | Basic Ion Optical Element 2 | Free Flight Space L3 [62] | 1.6000 |
| | | Sector-Formed Electric Field [60] | Radius R1: 1<br>Deflection Angle θ3: 157.29 deg |
| | | Free Flight Space L [63] | 4.3062 |
| | | Inverted Deflection | |
| | | Sector-Formed Electric Field [61] | Radius R1: 1<br>Deflection Angle θ3: 157.29 deg |
| | | Inverted Deflection | |
| | | Free Flight Space L4 [64] | 1.6000 |
| Time-Focusing Unit Structure [T4] | Basic Ion Optical Element 2 | Free Flight Space L3 [67] | 1.6000 |
| | | Inverted Deflection | |
| | | Sector-Formed Electric Field [65] | Radius R1: 1<br>Deflection Angle θ3: 157.29 deg |
| | | Inverted Deflection | |
| | | Free Flight Space L [68] | 4.3062 |
| | | Sector-Formed Electric Field [66] | Radius R1: 1<br>Deflection Angle θ3: 157.29 deg |
| | | Free Flight Space L4 [69] | 1.6000 |

(1|x) = 0.000, (1|a) = 0.000, (1|d) = 0.000
L1 + L2 = 3.2000

Also in the multi-turn ion optical system of the second embodiment, one cycle of loop orbit is formed by two time-focusing unit structures T3 and T4. In one time-focusing unit structure T3, a basic ion optical element includes two sector-formed electric fields 60 and 61 and a free flight space 63 with a length of L existing between the two sector-formed electric fields 60 and 61. Each of the sector-formed electric fields 60 and 61 is formed by a sector-formed electrode composed of an outer electrode and an inner electrode. The sector-formed electric fields 60 and 61 have the identical configuration, a radius of the central orbit of R1=1, a deflection angle of 157.29 [deg]. With respect to this basic ion optical element, a free flight space 62 with a length of L3 is provided at the injection side, and a free flight space 64 with a length of L4 at the ejection side, guaranteeing that ions departing from the time-focusing point P3 are time-focused at the point P4. The other time-focusing unit structure T4 has exactly the same configuration and parameters as the time-focusing unit structure T3. Also regarding this multi-turn ion optical system, a numerical computation has confirmed that (l|x)=(l|a)=(l|d)=0 is satisfied at the time-focusing points P3 and P4 at every half turn of the loop orbit.

Figure 7:
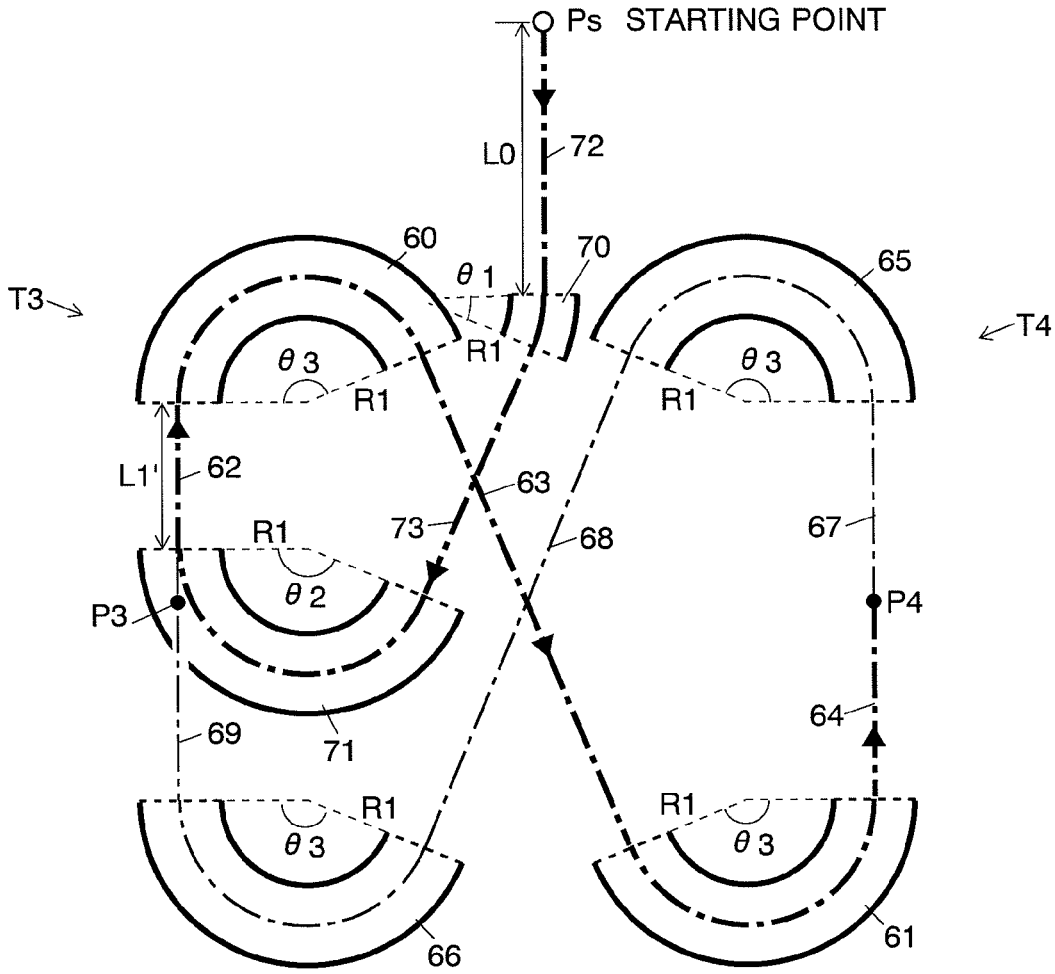
FIG. 7 is a schematic configuration diagram illustrating a state in which an injection ion optical system is included in the multi-turn ion optical system illustrated in FIG. 6.

FIG. 7 is a schematic configuration diagram of an example in the case where the injection ion optical system according to the present invention is provided in the multi-turn ion optical system illustrated in FIG. 6. The parameters of each element in this case are shown in Table 4.

TABLE 4

| | | |
|---|---|---|
| | Free Flight Space L0 [72] | 1.8858 |
| Basic Ion Optical Element 1 | Sector-Formed Electric Field [70] | Radius R1: 1<br>Deflection Angle θ1: 23.8 deg |
| | Free Flight Space L [73] | 2.0637 |
| | Sector-Formed Electric Field [71] | Radius R1: 1<br>Deflection Angle θ2: 156.2 deg |
| | Free Flight Space L1' | 1.0000 |
| Basic Ion Optical Element 2 | Sector-Formed Electric Field [60] | Radius R1: 1<br>Deflection Angle θ3: 157.29 deg |
| | Free Flight Space L [63] | 4.3062 |
| | Inverted Deflection<br>Sector-Formed Electric Field [61] | Radius R1: 1<br>Deflection Angle θ3: 157.29 deg |
| | Inverted Deflection<br>Free Flight Space L4 [64] | 1.6000 |

(1|x) = 0.000, (1|a) = 0.000, (1|d) = 0.000
L1 + L2 = 3.2000

As described earlier, the basic ion optical element that is combined as the injection ion optical system or the ejection ion optical system does not necessarily have to be the same as the basic ion optical element that composes the time-focusing unit structure. Important criteria of selecting a basic ion optical element which is added as an injection ion optical system or an ejection ion optical system include not only the time-focusing property but the property of the passage ratio of ions. Furthermore, the entire installation area is practically an important criterion. From the standpoint of the passage ratio of ions, it is necessary to combine a basic ion optical element which does not increase the deviation and angle of the orbit of ions after the ions have passed through the injection ion optical system or the ejection ion optical system. A numerical computation performed regarding the multi-turn ion optical system shown in FIG. 6 and Table 3 revealed that combining the basic ion optical element of the multi-turn ion optical system itself as the injection ion optical system or ejection ion optical system increases the deviation and angle of the orbit of ions. Given this factor, in this embodiment, the basic ion optical element of the first embodiment is combined to the multi-turn ion optical system illustrated in FIG. 6 to configure the injection ion optical system and ejection ion optical system.

That is, a new basic ion optical element including a sector-formed electric fields 70 and 71 and a free flight space 73, which are respectively the same as the sector-formed electric fields 40 and 41 and the free flight space 43, is inserted to the injection-side free flight space 62 in the time-focusing unit structure T3. The distance L3' of the free flight space between the ejection end section of the sector-formed electric field 71 and the injection end section of the sector-formed electric field 60 of the time-focusing unit structure T3 is set to be 1.0. The distance L0 of the injection-side free flight space 72 between the ion starting point Ps and the injection end section of the sector-formed electric field 70 is obtained and determined from the equation (23) to be L0=1.8858. Regarding the injection ion optical system designed in this manner, a numerical computation has confirmed that (1|x)=(1|a)=(1|d)=0 is satisfied at the time-focusing point P4. L3' can be appropriately adjusted to reasonably arrange the electrodes.

Figure 8:
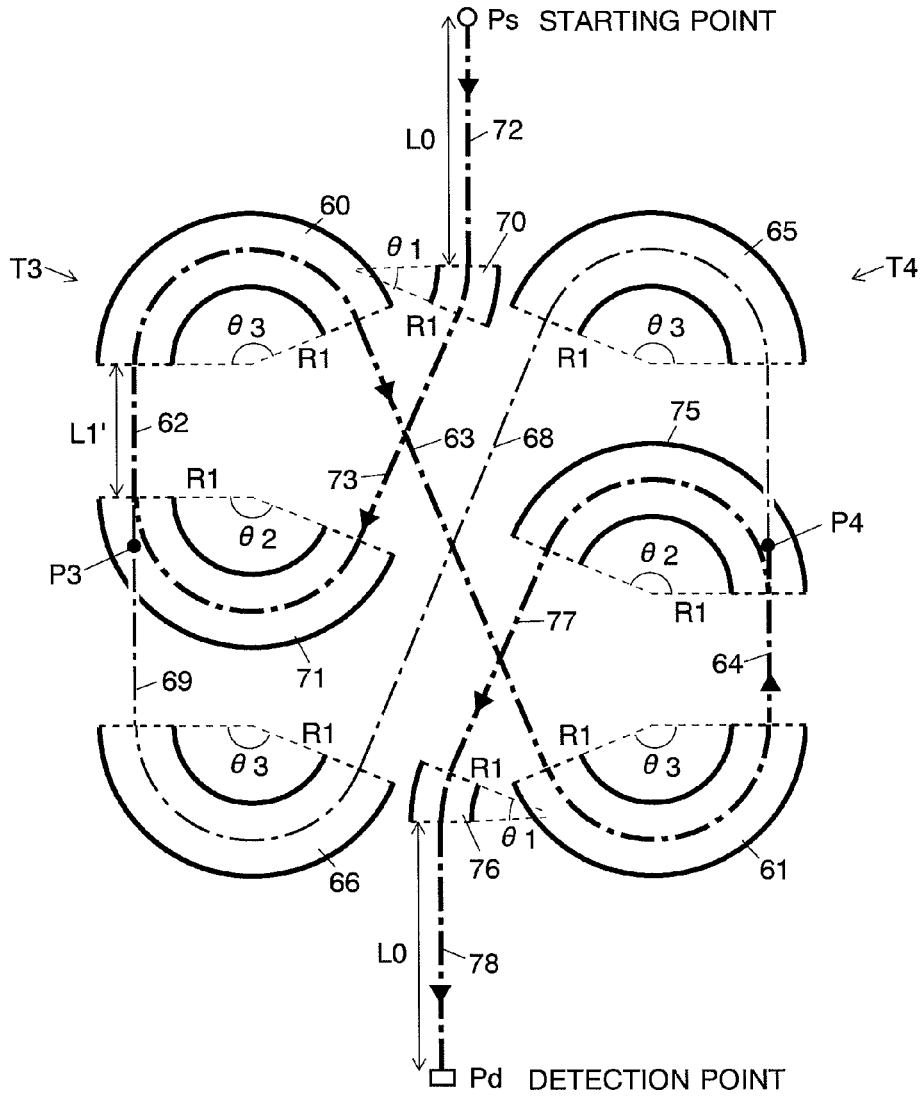
FIG. 8 is a schematic configuration diagram illustrating a state in which an injection ion optical system and an ejection ion optical system are included in the multi-turn ion optical system illustrated in FIG. 6.

The ejection ion optical system can be configured in the same manner. FIG. 8 is a schematic configuration diagram of an example in the case where an ejection ion optical system according to the present invention is additionally provided to the multi-turn ion optical system illustrated FIG. 7. That is, a new basic ion optical element including sector-formed electric fields 75 and 76 and a free flight space 77 is inserted to the ejection-side free flight space 64 in the time-focusing unit structure T3. The distance L4' of the free flight space between the injection end section of the sector-formed electric field 75 and the ejection end section of the sector-formed electric field 61 of the time-focusing unit structure T3 is set to be 1.0. The parameters of the newly-added basic ion optical element are exactly the same as those of the time-focusing unit structure T1 used for forming the injection ion optical system. The distance L0 of the ejection-side free flight space 78 between the ejection end section of the sector-formed electric field 76 and the detection point Pd was set to be 1.8858 which was obtained from the equation (23).

A numerical computation regarding an ejection ion optical system having such a configuration has confirmed that ions which depart the time-focusing point P3 in the multi-turn ion optical system are time-focused at the detection point Pd. The direction of deflection in connecting the basic ion optical element is determined to minimize the installation area. This arrangement is well possible unless the electrodes do not touch for example. Arranging inversely the direction of deflections of course does not affect the time-focusing property.

As specifically described above, with the present invention, it is possible to easily design an injection ion optical system and ejection ion optical system which can achieve a time focusing with respect to the time-focusing point on the loop orbit of a multi-turn ion optical system. In addition, having relatively a lot of flexibility in the arrangement of the ion optical elements, it is also advantageous in decreasing the size of the apparatus.

It should be noted that the embodiments described thus far are merely an example of the present invention, and it is evident that any modification, adjustment, or addition made within the spirit of the present invention is also covered by the present patent application.

The invention claimed is:

1. A mass spectrometer having a multi-turn optical system for forming a closed loop orbit in which a plurality of sector-formed electric fields and free flight spaces free from an electric field are combined, and the mass spectrometer in which ions are made to fly along the loop orbit repeatedly so as to separate the ions in accordance with their mass-to-charge ratio, wherein:

the multi-turn ion optical system is composed of a plurality of connected time-focusing unit structures, and each of the time-focusing unit structures comprises:

a basic ion optical element including at least one sector-formed electric field, having a time-focusing property with respect to a variation of an initial position and an initial angle of the ions, and satisfying a condition that a temporal aberration coefficient dependent on an energy of an ion is positive;

an injection-side free flight space for guiding an ion so as to inject the ion to the basic ion optical element; and an ejection-side free flight space for guiding an ion that has exited from the basic ion optical element, a basic ion optical element for injection ion optical system is inserted in the injection-side free flight space in one of the plurality of time-focusing unit structures in such a manner that an ejection axis of the basic ion optical element for injection ion optical system coincides with an injection axis of the injection-side free flight space; and an injection-side free flight space is placed between an injection end of the basic ion optical element for injection ion optical system and an ion starting point which is an ion source, where the injection-side free flight space has a length uniquely determined by: a distance from an ejection end of the basic ion optical element for injection ion optical system to an injection end of a basic ion optical element in the time-focusing unit structure in which the basic ion optical element for injection ion optical system is inserted; a length of an injection-side free flight space, which is a distance between an ion injection point to the time-focusing unit structure and an ion injection point to the basic ion optical element of the unit structure; and a length of an ejection-side free flight space, which is a distance between an ion ejection point from the basic ion optical element of the time-focusing unit structure and an ion ejection point from the unit structure.

2. The mass spectrometer according to claim 1, wherein the length of the injection-side free flight space between the injection end of the basic ion optical element for injection ion optical system and the ion starting point is adjusted to cancel a sum of temporal aberration coefficients which depend on energies generated in the basic ion optical element for injection ion optical system and in the time-focusing unit structure of the multi-turn ion optical system.

3. The mass spectrometer according to claim 1, wherein the length L0 of the injection-side free flight space between the injection end of the basic ion optical element for injection ion optical system and the ion starting point is determined by the following equation:

$$L0=2(L1+L2)-(L1'+L2)$$

where L1' is the distance from the ejection end of the basic ion optical element for injection ion optical system to the injection end of the basic ion optical element in the time-focusing unit structure in which the basic ion optical element for injection ion optical system is inserted, L1 is the length of the injection-side free flight space in the time-focusing unit structure, and L2 is the length of the ejection-side free flight space in the time-focusing unit structure.

4. A mass spectrometer having a multi-turn optical system for forming a closed loop orbit in which a plurality of sector-formed electric field and free flight spaces free from an electric field are combined, and the mass spectrometer in which ions are made to fly along the loop orbit repeatedly so as to separate the ions in accordance with their mass-to-charge ratio, wherein:

the multi-turn ion optical system is composed of a plurality of connected time-focusing unit structures, and each of the time-focusing unit structures comprises:

a basic ion optical element including at least one sector-formed electric field, having a time-focusing property with respect to a variation of an initial position and an initial angle of the ions, and satisfying a condition that a temporal aberration coefficient dependent on an energy of an ion is positive;

an injection-side free flight space for guiding an ion so as to inject the ion to the basic ion optical element; and an ejection-side free flight space for guiding an ion that has exited from the basic ion optical element, a basic ion optical element for ejection ion optical system is inserted in the ejection-side free flight space in one of the plurality of time-focusing unit structures in such a manner that an injection axis of the basic ion optical element for ejection ion optical system corresponds to an ejection axis of the ejection-side free flight space; and an ejection-side free flight space is placed between an ejection end of the basic ion optical element for ejection ion optical system and an ion detection point which is an ion detector, where the ejection-side free flight space has a length uniquely determined by: a distance from an injection end of the basic ion optical element for ejection ion optical system to an ejection end of a basic ion optical element in the time-focusing unit structure in which the basic ion optical element for ejection ion optical system is inserted; a length of an injection-side free flight space, which is a distance between an ion injection point to the time-focusing unit structure and an ion injection point to the basic ion optical element of the unit structure; and a length of an ejection-side free flight space, which is a distance between an ion ejection point from the basic ion optical element of the time-focusing unit structure and an ion ejection point from the unit structure.

5. The mass spectrometer according to claim 4, wherein the length of the ejection-side free flight space between the ejection end of the basic ion optical element for ejection ion optical system and the ion detection point is adjusted to cancel a sum of temporal aberration coefficients which depend on energies generated in the basic ion optical element for ejection ion optical system and in the time-focusing unit structure of the multi-turn ion optical system.

6. The mass spectrometer according to claim 4, wherein the length L0 of the ejection-side free flight space between the ejection end of the basic ion optical element for ejection ion optical system and the ion detection point is determined by the following equation:

$$L0=2(L1+L2)-(L1'+L2)$$

where L1' is the distance from the injection end of the basic ion optical element for ejection ion optical system to the ejection end of the basic ion optical element in the time-focusing unit structure in which the basic ion optical element for ejection ion optical system is inserted, L1 is the length of the injection-side free flight space in the time-focusing unit structure, and L2 is the length of the ejection-side free flight space in the time-focusing unit structure.

7. The mass spectrometer according to claim 1, wherein the basic ion optical element for injection ion optical system has a same configuration as a configuration of the basic ion optical element of the time-focusing unit structure which composes the multi-turn ion optical system.

8. The mass spectrometer according to claim 4, wherein the basic ion optical element for ejection ion optical system has a same configuration as a configuration of the basic ion optical element of the time-focusing unit structure which composes the multi-turn ion optical system.

* * * * *